US010199050B2

(12) United States Patent
Lee

(10) Patent No.: US 10,199,050 B2
(45) **Date of Patent: *Feb. 5, 2019**

(54) SIGNAL CODEC DEVICE AND METHOD IN COMMUNICATION SYSTEM

(71) Applicant: Electronics and Telecommunications Research Institute, Daejeon (KR)

(72) Inventor: Mi-Suk Lee, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/645,630

(22) Filed: Jul. 10, 2017

(65) Prior Publication Data

US 2017/0309287 A1 Oct. 26, 2017

Related U.S. Application Data

(63) Continuation of application No. 14/354,881, filed as application No. PCT/KR2012/008893 on Oct. 26, 2012.

(30) Foreign Application Priority Data

Oct. 28, 2011 (KR) ..... 10-2011-0111557
Oct. 25, 2012 (KR) ..... 10-2012-0119152

(51) Int. Cl.
*G10L 19/00* (2013.01)
*G10L 21/00* (2013.01)
*G10L 19/26* (2013.01)

(52) U.S. Cl.
CPC ..... *G10L 19/26* (2013.01); *G10L 2019/0001* (2013.01)

(58) Field of Classification Search
None
See application file for complete search history.

(56) References Cited

U.S. PATENT DOCUMENTS 5,778,335 A 7/1998 Ubale et al.
7,783,480 B2 8/2010 Yoshida
(Continued)

FOREIGN PATENT DOCUMENTS

KR 1020010022187 A 3/2001
KR 1020030001523 A 1/2003
(Continued)

OTHER PUBLICATIONS

Bruno Bessette et al., "The Adaptive Multirate Wideband Speech Codec (AMR-WB)," IEEE Transactions on Speech and Audio Processing, Nov. 2002, pp. 620-636, vol. 10, No. 8, IEEE.

*Primary Examiner* — Satwant Singh
(74) *Attorney, Agent, or Firm* — William Park & Associates Ltd.

(57) ABSTRACT

The present invention relates to a codec device and method for encoding/decoding voice and audio signals in a communication system, wherein: a fixed codebook excited signal is generated by using a pulse index for a voice signal; a first adaptive codebook excited signal is generated by using a pitch index for the voice signal; a fixed codebook signal is generated by multiplying the fixed codebook excited signal by a fixed codebook gain; a first adaptive codebook signal is generated by multiplying the first adaptive codebook excited signal by a first adaptive codebook gain; and a synthesized filter excited signal is generated by adding the fixed codebook signal and the first adaptive codebook signal.

1 Claim, 4 Drawing Sheets

(56) References Cited

U.S. PATENT DOCUMENTS

| | | | | |
|---|---|---|---|---|
| 7,848,921 | B2 | 12/2010 | Ehara | |
| 7,912,712 | B2 | 3/2011 | Shlomot et al. | |
| 7,978,771 | B2 * | 7/2011 | Sato | G10L 19/24 375/259 |
| 8,239,191 | B2 | 8/2012 | Ehara et al. | |
| 8,725,501 | B2 | 5/2014 | Ehara | |
| 9,704,501 | B2 * | 7/2017 | Lee | G10L 19/26 |
| 2005/0010402 | A1 | 1/2005 | Sung et al. | |
| 2005/0010404 | A1 | 1/2005 | Son et al. | |
| 2008/0071530 | A1 | 3/2008 | Ehara | |
| 2015/0317994 | A1 | 11/2015 | Ramadas et al. | |

FOREIGN PATENT DOCUMENTS

| | | | |
|---|---|---|---|
| KR | 1020050006883 | A | 1/2005 |
| KR | 1020050007117 | A | 1/2005 |
| KR | 1020060030012 | A | 4/2006 |
| KR | 100651712 | B1 | 11/2006 |
| KR | 1020080102262 | A | 11/2008 |
| KR | 1020110086919 | A | 8/2011 |
| WO | 1999062057 | A2 | 12/1999 |
| WO | 2000025298 | A1 | 5/2000 |
| WO | 2001091112 | A1 | 11/2001 |
| WO | 2005064591 | A1 | 7/2005 |
| WO | 2007099244 | A2 | 9/2007 |

* cited by examiner

SIGNAL CODEC DEVICE AND METHOD IN COMMUNICATION SYSTEM

CROSS-REFERENCES TO RELATED APPLICATIONS

The present application is a continuation application of U.S. application Ser. No. 14/354,881, Apr. 28, 2014 and claims priorities of Korean Patent Application Nos. 10-2011-0111557 and 10-2012-0119152, filed on Oct. 18, 2011, and Oct. 25, 2012, respectively, which are incorporated herein by reference in their entireties.

BACKGROUND OF THE INVENTION

Field of the Invention

Exemplary embodiments of the present invention relate to a communication system and, more particularly, to a codec apparatus and method for coding/decoding a speech and audio signal in a communication system.

Description of Related Art

In a communication system, active research are being carried out in order to provide users with various types of Quality of Services (hereinafter referred to as 'QoSs') having a high transfer rate. In this communication system, schemes for transmitting data having various types of QoSs through limited resources rapidly are being proposed. With the recent development of networks and the recent increase of user demands for high quality service, speech/audio codecs have been developed as schemes for compressing and transmitting a speech and audio signal in a network.

Meanwhile, in order to transmit and receive a speech and audio signal over a digital communication network, an encoder for compressing the speech and audio signal converted into a digital signal and a decoder for restoring the speech and audio signal from the compressed signal are essential to a communication system. In general, the encoder and the decoder are collectively called a codec or coder. As an example of a proposed codec, one of the most widely used speech/audio codec techniques is a Code Excited Linear Prediction (hereinafter referred to as 'CELP') codec. The CELP codec is represented by a synthesis filter indicative of the constellation of a speech and audio signal and an excited signal corresponding to the input of the synthesis filter.

Furthermore, the CELP codec includes an Adaptive Multi-Rate (AMR) codec, that is, a narrowband codec, and an Adaptive Multi-Rate WideBand (AMR-WB) codec, that is, a wideband codec. In an encoder, each of the barrowband AMR codec and the wideband AMR-WB codec extracts the coefficient of the synthesis filter from an input signal of one frame corresponding to 20 msec, splits the one frame into subframes of 5 msec, calculates a pitch index and the gain of an adaptive codebook and a pulse index and the gain of a fixed codebook, quantizes the calculated parameters, and sends the quantized parameters to a decoder. In the decoder, each of the barrowband AMR codec and the wideband AMR-WB codec generates excited signals by using the pitch index and the gain of the adaptive codebook and the pulse index and the gain of the fixed codebook and restore a speech and audio signal by filtering the excited signals through the synthesis filter.

The wideband AMR-WB codec further sends information on a Voice Activity Detection (VAD) flag and a Long Term Predictor (LTP) filter flag as a transmission parameter. The VAD flag indicates whether a VAD function operates or not, and the LTP filter flag indicates whether a Low-Pass Filter (hereinafter referred to as an 'LPF') will be applied to an adaptive codebook excited signal or not. The LTP filter flag is transmitted in modes other than two lower modes having a low bit rate, from among the 9 bit rate modes of the wideband AMR-WB codec.

Meanwhile, the barrowband AMR codec, that is, a narrowband codec, codes a signal of a 300~3400 Hz band, whereas the wideband AMR-WB codec, that is, a wideband codec, codes a signal of a 50~7,000 Hz band. That is, the wideband codec processes a signal having a frequency band twice wider than that of the narrowband codec. Thus, in the case of a wideband signal, a harmonic component on the spectra of a signal represented by an adaptive codebook parameter may appear in all frequency bands of 50~7,000 Hz. However, the wideband signal includes a harmonic component that appears only in a relatively low frequency band, but also includes a harmonic component that is weak or does not appear in a high frequency band. In order to represent a signal having a weak harmonic component in a high frequency band, the wideband AMR-WB codec extracts an adaptive codebook parameter by using the LPF. That is, the narrowband codec and the wideband codec, particularly, the wideband codec uses an adaptive codebook excited signal without change if a harmonic component on the spectrum of a speech and audio signal appears in all frequency bands, but uses an adaptive codebook excited signal filtered by the LPF if a harmonic component is weak in a high frequency band.

If a harmonic component is weak in a high frequency band as described above, however, the narrowband codec and the wideband codec, particularly, a wideband codec has to use an adaptive codebook excited signal filtered by the LPF and send information indicating whether the LPF has been applied or not, that is, information on the LTP filter flag, to the decoder. In this case, there is a problem in that 1 bit is necessary for each subframe, that is, 4 bits per frame, in order to send information on the LTP filter flag.

Accordingly, in order to provide a speech and audio service having high quality in a communication system, there is a need for a codec for coding/decoding a speech and audio signal with no need for a narrowband codec and a wideband codec, particularly, the wideband codec to send additional information, for example, information on the LTP filter flag.

SUMMARY OF THE INVENTION

An embodiment of the present invention is directed to providing a codec apparatus and method for coding/decoding a signal in a communication system.

Another embodiment of the present invention is directed to providing a codec apparatus and method for providing a speech and audio service having high quality by coding/decoding a speech and audio signal through a narrowband codec and a wideband codec when a CELP codec is used in a communication system.

Yet another embodiment of the present invention is directed to providing a codec apparatus and method for coding/decoding a speech and audio signal with no need for a narrowband codec and a wideband codec to send additional information in a communication system.

Yet further another embodiment of the present invention is directed to providing a codec apparatus and method for coding/decoding a speech and audio signal with no need for a narrowband codec and a wideband codec in a communication system, particularly, a wideband codec to send additional information, for example, information on an LTP filter flag.

In accordance with an embodiment of the present invention, a codec apparatus for coding/decoding a signal in a communication system includes a first generator configured to generate a fixed codebook excited signal by using a pulse index for a speech signal, a second generator configured to generate a first adaptive codebook excited signal by using a pitch index for the speech signal, a first multiplier configured to generate a fixed codebook signal by multiplying the fixed codebook excited signal by a fixed codebook gain, a second multiplier configured to generate a first adaptive codebook signal by multiplying the first adaptive codebook excited signal by a first adaptive codebook gain, and a summer configured to generate a synthesis filter excited signal by summing up the fixed codebook signal and the first adaptive codebook signal.

In accordance with another embodiment of the present invention, a method of a codec apparatus coding/decoding a signal in a communication system includes generating a fixed codebook excited signal by using a pulse index for a speech signal, generating a first adaptive codebook excited signal by using a pitch index for the speech signal, generating a fixed codebook signal by multiplying the fixed codebook excited signal by a fixed codebook gain, generating a first adaptive codebook signal by multiplying the first adaptive codebook excited signal by a first adaptive codebook gain, and generating a synthesis filter excited signal by summing up the fixed codebook signal and the first adaptive codebook signal.

DESCRIPTION OF SPECIFIC EMBODIMENTS

Figure 1:
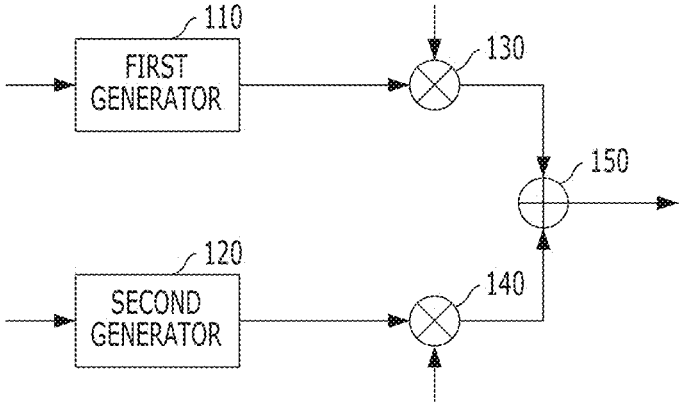
FIGS. 1 and 6 are schematic diagrams showing the structures of codec apparatuses in a communication system in accordance with some embodiments of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention.

The present invention proposes a signal codec apparatus and method in a communication system. Although embodiments of the present invention propose a codec apparatus and method for coding/decoding a speech and audio signal for providing various types of QoSs, for example, a speech and audio service in a communication system, the proposed codec of the present invention can also be likewise applied to cases where signals corresponding to other services are coded/decoded.

Furthermore, embodiments of the present invention propose a codec apparatus and method for coding/decoding a speech and audio signal in a communication system. In an embodiment of the present invention, if a CELP codec is used, a narrowband codec and a wideband codec codes/decodes a speech and audio signal and provides a speech and audio service having high quality.

Furthermore, in a communication system in accordance with an embodiment of the present invention, in an encoder, each of the narrowband codec and the wideband codec of the CELP codec extracts the coefficient of a synthesis filter from an input signal of one frame, that is, a speech and audio signal, splits the one frame into subframes, calculates a pitch index and the gain of an adaptive codebook and a pulse index and the gain of a fixed codebook, quantizes the calculated parameters, and sends the quantized parameters to a decoder. In the decoder, each of the narrowband codec and the wideband codec of the CELP codec generates excited signals by using the pitch index and the gain of the adaptive codebook and the pulse index and the gain of the fixed codebook and restores the speech and audio signal by filtering the excited signals through the synthesis filter.

In a communication system in accordance with an embodiment of the present invention, the narrowband codec and the wideband codec of the CELP codec, particularly, a wideband codec does not additionally send information on whether an LPF has been applied to an adaptive codebook excited signal or not, for example, information on an LTP filter flag. Instead, the narrowband codec and the wideband codec normally code/decode a speech and audio signal by adjusting the harmonic component of an adaptive codebook excited signal according to a frequency band without sending the additional information and thus provide a speech and audio service having high quality. A codec apparatus in a communication system in accordance with an embodiment of the present invention is described in detail below with reference to FIGS. 1 and 6.

FIG. 1 is a schematic diagram showing the structure of a codec apparatus in a communication system in accordance with an embodiment of the present invention. FIG. 1 is a schematic diagram showing the structure of a narrowband codec, for example, an Adaptive Multi-Rate (AMR) codec apparatus in the narrowband codec and the wideband codec of the aforementioned CELP codec.

Referring to FIG. 1, the narrowband codec apparatus includes a first generator 110 for generating a fixed codebook excited signal by using a pulse index, a second generator 120 for generating an adaptive codebook excited signal by using a pitch index, a first multiplier 130 for generating a fixed codebook signal by multiplying the fixed codebook excited signal by a fixed codebook gain, a second multiplier 140 for generating an adaptive codebook signal by multiplying the adaptive codebook excited signal by an adaptive codebook gain, and a summer 150 for generating a synthesis filter excited signal by summing up the fixed codebook signal and the adaptive codebook signal.

As described above, in an encoder, the narrowband codec apparatus extracts the coefficient of a synthesis filter from an input signal of one frame, that is, a speech and audio signal, splits the one frame into subframes, and calculates a pitch index and the gain of an adaptive codebook and a pulse index and the gain of a fixed codebook. In a decoder, the narrowband codec apparatus generates excited signals by using the pitch index and the gain of the adaptive codebook and the pulse index and the gain of the fixed codebook and restores the speech and audio signal by filtering the excited signals through the synthesis filter.

That is, the first generator 110 receives the pulse index, that is, the pulse index of the fixed codebook, and generates the fixed codebook excited signal through the fixed codebook by using the pulse index.

The first multiplier 130 generates the fixed codebook signal by multiplying the fixed codebook excited signal by the fixed codebook gain, that is, the gain of the fixed codebook.

The second generator 120 receives the pitch index, that is, the pitch index of the adaptive codebook and generates the adaptive codebook excited signal through the adaptive codebook by using the pitch index.

The second multiplier 140 generates the adaptive codebook signal by multiplying the adaptive codebook excited signal by the adaptive codebook gain, that is, the gain of the adaptive codebook.

The summer 150 generates the synthesis filter excited signal by summing up the fixed codebook signal and the adaptive codebook signal.

Here, an error between the input signal, pre-processed by the encoder, and the pulse index and the fixed codebook gain and between the input signal, pre-processed by the encoder, and the pitch index and the adaptive codebook gain has a minimum value as described above.

Figure 2:
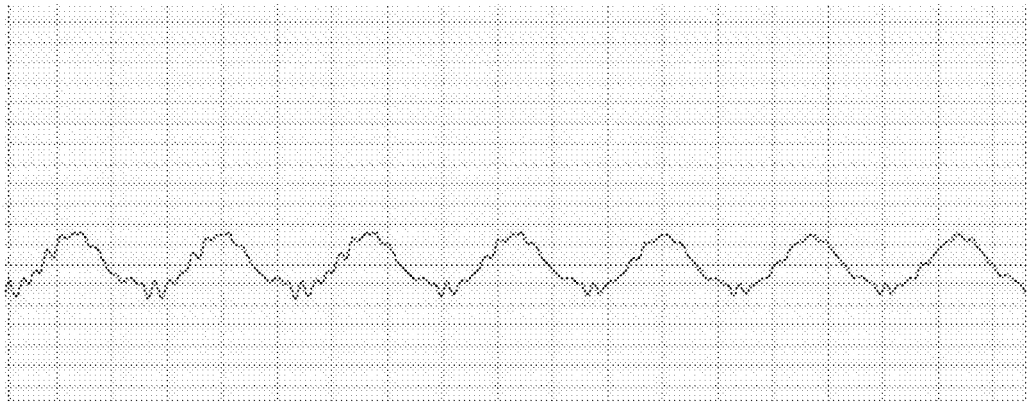
FIGS. 2 and 4 are schematic diagrams showing the waveforms of speech and audio signals in a communication system in accordance with some embodiments of the present invention.
Figure 3:
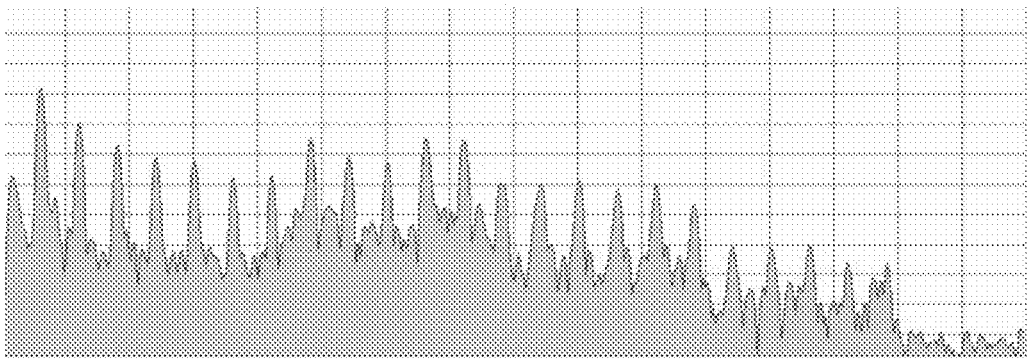
FIGS. 3 and 5 are schematic diagrams showing the spectra of speech and audio signals in a communication system in accordance with some embodiments of the present invention.
Figure 4:
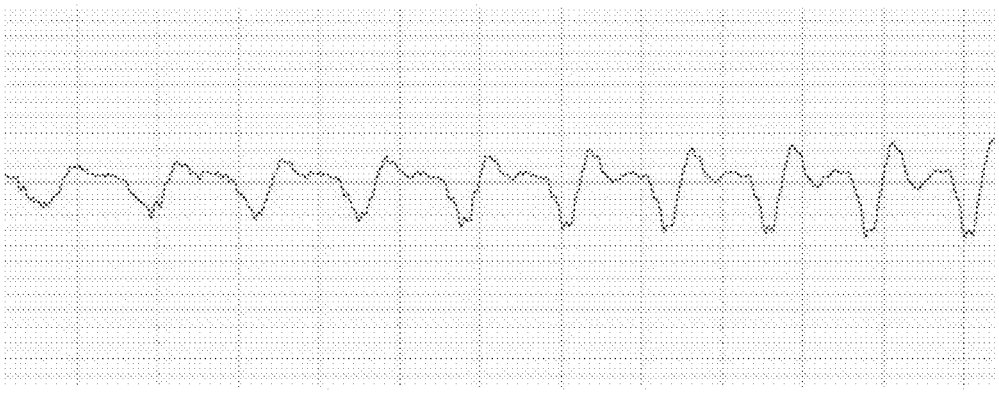
Figure 5:
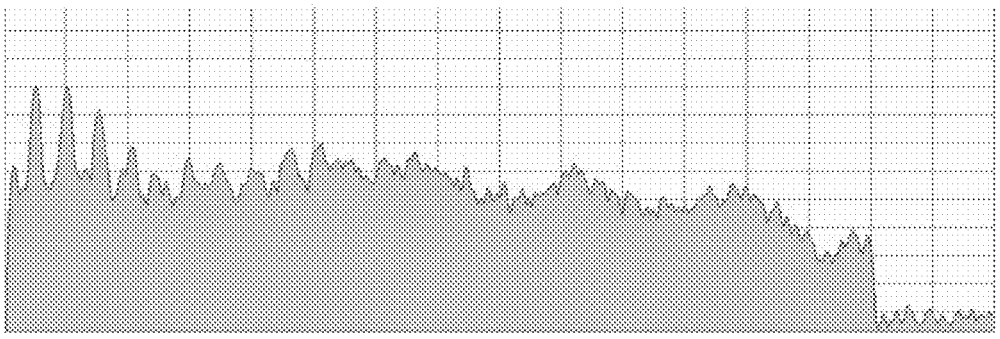

Meanwhile, in a communication system in accordance with an embodiment of the present invention, the wideband codec codes a signal of a 50~7,000 Hz band which is about twice wider than a signal of a 300~3,400 Hz band that is coded by the narrowband codec. In particular, in the case of a speech and audio signal, in the spectrum of a speech and audio signal including a stable speech sound, a harmonic component of up to 7,000 Hz band appears. In contrast, not in the case of the speech and audio signal including a speech sound, that is, in a speech and audio signal including a speechless sound, a harmonic component may be weaker in a high frequency band than in a low frequency band. That is, regarding the speech and audio signals, such as those shown in FIGS. 2 and 4, the spectra of speech and audio signals, such as those shown in FIGS. 3 and 5, appear. FIGS. 2 and 4 are schematic diagrams showing the waveforms of speech and audio signals in a communication system in accordance with an embodiment of the present invention, and FIGS. 3 and 5 are schematic diagrams showing the spectra of speech and audio signals in a communication system in accordance with an embodiment of the present invention.

That is, in a communication system in accordance with an embodiment of the present invention, in the case of the wideband codec, for example, an AMR-WB codec, when the AMR-WB codec operates in 12.65 kbps~23.85 kbps mode, an LPF is selectively applied to an adaptive codebook excited signal in order to adjust the harmonic component of the adaptive codebook excited signal in a relatively high frequency band. That is, in an encoder, when operating in 12.65 kbps~23.85 kbps mode, the wideband codec of a communication system in accordance with an embodiment of the present invention determines whether or not to use an adaptive codebook excited signal without change or whether or not to reduce the harmonic characteristic of the adaptive codebook excited signal in a high frequency band by filtering the adaptive codebook excited signal through an LPF and sends information corresponding to a result of the determination to a decoder.

The information corresponding to a result of the determination, that is, information on whether the LPF will be applied or not, as described above, is information on an LTP filter flag. In a communication system in accordance with an embodiment of the present invention, information on the LTP filter flag is not transmitted as described above, and whether the LPF has been applied or not is determined based on a speech factor that is calculated by the encoder and the decoder of the wideband codec, that is, the AMR-WB codec.

The speech factor is a value indicative of a probability that an input signal will be a speech and audio signal including a speech sound. As the speech factor becomes high, the input signal becomes a speech and audio signal including a speech sound. In this case, it is determined that the LPF has not been applied. That is, without sending information on the LTP filter flag, the wideband codec of a communication system in accordance with an embodiment of the present invention determines that when the speech factor is smaller than a predetermined threshold, an input signal is not a speech and audio signal including a speech sound, that is, the input signal is a speech and audio signal including a speechless sound, and reduces the harmonic component of an adaptive codebook excited signal in a high frequency band by filtering the adaptive codebook excited signal through the LPF. A wideband codec apparatus in a communication system in accordance with an embodiment of the present invention is described in more detail below with reference to FIG. 6.

Figure 6:
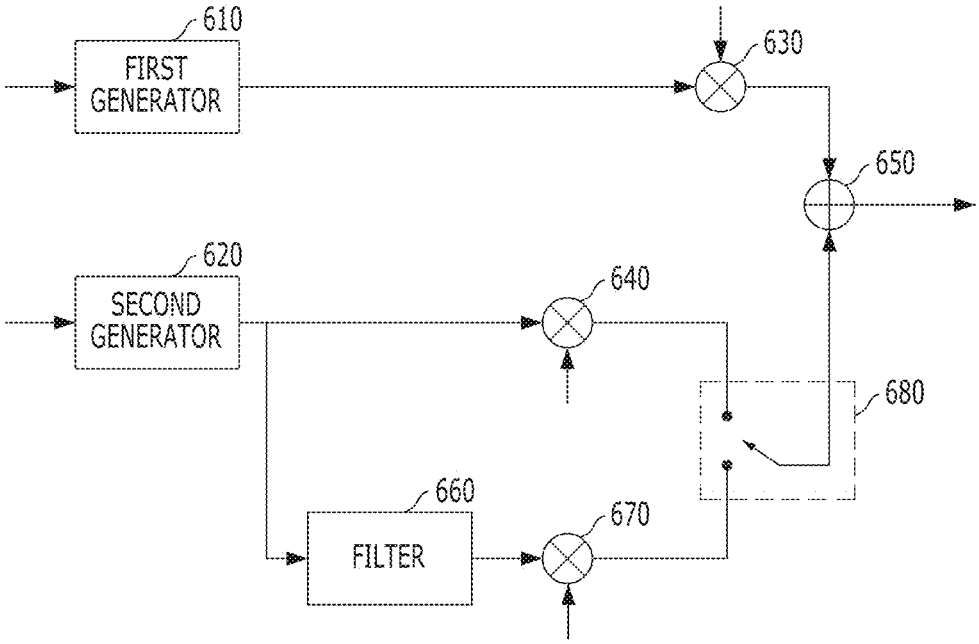

FIG. 6 is a schematic diagram showing the structure of a codec apparatus in a communication system in accordance with an embodiment of the present invention. FIG. 6 is a schematic diagram showing the structure of a wideband codec, for example, an AMR-WB codec apparatus in the narrowband codec and the wideband codec of the aforementioned CELP codec.

Referring to FIG. 6, the wideband codec apparatus includes a first generator 610 for generating a fixed codebook excited signal by using a pulse index, a second generator 620 for generating an adaptive codebook excited signal by using a pitch index, a first multiplier 630 for generating a fixed codebook signal by multiplying the fixed codebook excited signal by a fixed codebook gain, a second multiplier 640 for generating a first adaptive codebook signal by multiplying the adaptive codebook excited signal by an adaptive codebook gain, a filter 660 for filtering the adaptive codebook excited signal through an LPF, a third multiplier 670 for generating a second adaptive codebook signal by multiplying the filtered adaptive codebook excited signal by a filtered adaptive codebook gain, a selector 680 for selecting one of the first adaptive codebook signal and the second adaptive codebook signal as the final adaptive codebook signal based on a speech factor, and a summer 650 for generating a synthesis filter excited signal by summing up the fixed codebook signal and the final adaptive codebook signal.

As described above, in an encoder, the wideband codec apparatus of FIG. 6 extracts the coefficient of a synthesis filter from an input signal of one frame, that is, a speech and audio signal, splits the one frame into subframes, and calculates the pitch index and the gain of the adaptive codebook and the pulse index and the gain of the fixed codebook. In a decoder, the wideband codec apparatus of FIG. 6 generates excited signals by using the pitch index and the gain of the adaptive codebook and the pulse index and the gain of the fixed codebook and restores the speech and audio signal by filtering the excited signals through the synthesis filter.

Furthermore, the wideband codec apparatus determines whether the LPF has been applied or not based on a speech factor that is calculated by the encoder and the decoder of the wideband codec, that is, the AMR-WB codec, without sending information on the LTP filter flag. The selector 680 selects one of the first adaptive codebook signal and the second adaptive codebook signal as the final adaptive codebook signal based on a result of the determination.

Here, the speech factor is a value indicative of a probability that an input signal will be a speech and audio signal including a speech sound. As the speech factor becomes high, that is, when the speech factor is greater than a predetermined threshold, the input signal is a speech and audio signal including a speech sound. In this case, it is determined that the LPF has not been applied and thus the selector 680 selects the first adaptive codebook signal as the final adaptive codebook signal. In contrast, as the speech factor becomes low, that is, when the speech factor is smaller than the threshold, the input signal is a speech and audio signal including a speechless sound. In this case, it is determined that the LPF has been applied and thus the selector 680 selects the second adaptive codebook signal as the final adaptive codebook signal.

That is, the first generator 610 receives the pulse index, that is, the pulse index of the fixed codebook and generates the fixed codebook excited signal through the fixed codebook by using the pulse index.

The second multiplier 630 generates the fixed codebook signal by multiplying the fixed codebook excited signal by the fixed codebook gain, that is, the gain of the fixed codebook.

The second generator 620 receives the pitch index, that is, the pitch index of the adaptive codebook and generates the adaptive codebook excited signal through the adaptive codebook by using the pitch index.

The second multiplier 640 generates the first adaptive codebook signal by multiplying the adaptive codebook excited signal by the adaptive codebook gain, that is, the gain of the adaptive codebook.

The filter 660 generates a filtered adaptive codebook excited signal, that is, a second adaptive codebook excited signal, by filtering the adaptive codebook excited signal through the LPF.

The third multiplier 670 generates the second adaptive codebook signal by multiplying the second adaptive codebook excited signal by the filtered adaptive codebook gain, that is, a second adaptive codebook gain. The second adaptive codebook gain is calculated using the second adaptive codebook excited signal.

The selector 680, as described above, selects one of the first adaptive codebook signal and the second adaptive codebook signal as the final codebook signal based on the speech factor. Here, the selector 680 selects the first adaptive codebook signal as the final codebook signal when the speech factor is greater than a threshold and selects the second adaptive codebook signal as the final codebook signal when the speech factor is smaller than the threshold.

The summer 650 generates the synthesis filter excited signal by summing up the fixed codebook signal and the final adaptive codebook signal.

Here, an error between the input signal, pre-processed by the encoder, and the pulse index and the fixed codebook gain and between the input signal, pre-processed by the encoder, and the pitch index and the adaptive codebook gain has a minimum value as described above. In particular, the selector 680 selects an adaptive codebook signal having a minimum error with the pre-processed input signal, from among the first adaptive codebook signal and the second adaptive codebook signal, as the final codebook signal based on the speech factor. An operation of the codec apparatus in a communication system in accordance with an embodiment of the present invention is described in more detail below with reference to FIG. 7.

Figure 7:
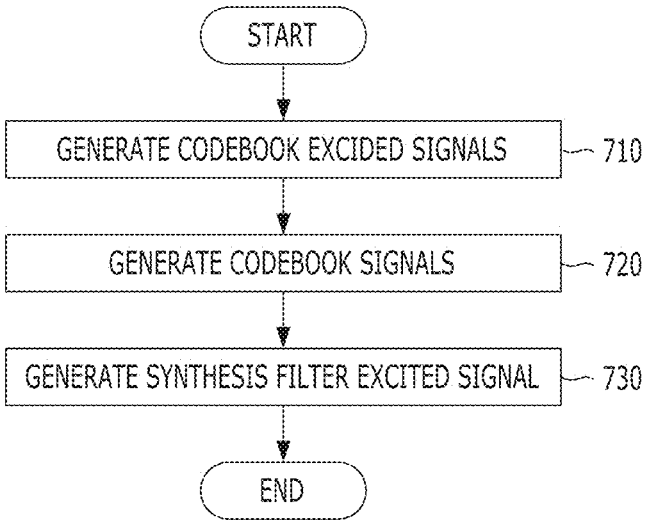
FIG. 7 is a schematic diagram showing an operation of the codec apparatus in a communication system in accordance with an embodiment of the present invention.

FIG. 7 is a schematic diagram showing an operation of the codec apparatus in a communication system in accordance with an embodiment of the present invention. FIG. 7 is a schematic diagram illustrating an operation of the codec apparatus using a CELP codec in a communication system in accordance with an embodiment of the present invention.

Referring to FIG. 7, at step 710, the codec apparatus generates codebook excited signals, that is, a fixed codebook excited signal and an adaptive codebook excited signal, by using a pulse index and a patch index as described above.

Next, at step 720, the codec apparatus generates codebook signals by multiplying the respective codebook excited signals by codebook gains. More particularly, the codec apparatus generates a fixed codebook signal by multiplying the fixed codebook excited signal by a fixed codebook gain and generates an adaptive codebook signal by multiplying the adaptive codebook excited signal by an adaptive codebook gain. Here, the codec apparatus generates a second adaptive codebook signal by multiplying the adaptive codebook excited signal filtered by the LPF, that is, a second adaptive codebook excited signal, by a filtered adaptive codebook gain, that is, a second adaptive codebook gain depending on whether the adaptive codebook excited signal has been filtered by the LPF or not. Furthermore, the codec apparatus selects the adaptive codebook signal or the second adaptive codebook signal as the final adaptive codebook signal based on a speech factor. More particularly, the codec apparatus selects the adaptive codebook signal as the final adaptive codebook signal when the speech factor is greater than a threshold and selects the second adaptive codebook signal as the final adaptive codebook signal when the speech factor is smaller than the threshold. The speech factor and the selection of the final adaptive codebook signal based on the speech factor have been described in detail above, and a description thereof is omitted.

Next, at step 730, the codec apparatus generates a synthesis filter excited signal by using the codebook signals. More particularly, the codec apparatus generates the synthesis filter excited signal by summing up the fixed codebook signal and the adaptive codebook signal or the final codebook signal. If the CELP codec is a narrowband codec, for example, the AMR codec of the CELP codec, the codec apparatus generates the synthesis filter excited signal by summing up the fixed codebook signal and the adaptive codebook signal. If the CELP codec is a wideband codec, for example, an AMR-WB, the codec apparatus generates the synthesis filter excited signal by summing up the fixed codebook signal and the final adaptive codebook signal depending on whether the adaptive codebook excited signal has been filtered by the LPF or not.

As described above, in a communication system in accordance with an embodiment of the present invention, each of a narrowband codec and a wideband codec, particularly, the wideband codec determines whether an excited signal has been filtered or not by an LPF, that is, whether an adaptive codebook excited signal has been filtered or not by an LPF, based on a speech factor without sending information on whether the excited signal has been filtered or not by the LPF, that is, information on an LTP filter flag, and generates a synthesis filter excited signal based on a result of the determination. Accordingly, the wideband codec can normally code/decode a speech and audio signal without sending additional information and thus provide a speech and audio service having high quality.

In a communication system of the present invention, if a CELP codec is used, each of a narrowband codec and a wideband codec codes/decodes a speech and audio signal without sending additional information. In particular, the wideband codec can normally code/decode a speech and audio signal by adjusting the harmonic component of an adaptive codebook excited signal according to a frequency band without sending additional information, for example, information on an LTP filter flag and thus provide a speech and audio service having high quality.

While the present invention has been described with respect to the specific embodiments, it will be apparent to those skilled in the art that various changes and modifications may be made without departing from the spirit and scope of the invention as defined in the following claims.

What is claimed is:

1. A method of processing a signal, the method comprising:

generating a first codebook excited signal;

determining a first codebook signal by applying the first codebook excited signal into a first codebook gain;

generating an adaptive second codebook excited signal;

determining whether a filtering is applied to the second codebook excited signal using LPF (Low Pass filter);

determining an second codebook signal by applying a second codebook excited signal into an second codebook gain; wherein the second codebook excited signal is filtered by the LPF or is not filtered by the LPF; and combining the first codebook signal and the second codebook signal.

* * * * *